United States Patent [19]

Gill et al.

[11] 4,223,949

[45] Sep. 23, 1980

[54] PROCESS FOR DISPOSAL OF SULFATE CONTAINING BRINES FROM DIAPHRAGM CELL CAUSTIC EVAPORATOR SYSTEMS

[75] Inventors: Jaswant S. Gill, Cleveland, Tenn.; Joseph L. Wood, Westminster, Md.; Nissim Rachima, Cleveland, Tenn.

[73] Assignee: Olin Corporation, New Haven, Conn.

[21] Appl. No.: 857

[22] Filed: Jan. 4, 1979

[51] Int. Cl.[2] ..... E21B 43/28

[52] U.S. Cl. ..... 299/5; 166/305 D

[58] Field of Search ..... 299/4, 5; 166/305 D; 23/298; 423/208

[56] References Cited

U.S. PATENT DOCUMENTS

| | | | |
|---|---|---|---|
| Re. 26,460 | 9/1968 | Axelrad et al. | 423/208 |
| 1,409,139 | 3/1922 | Glaeser | 423/208 X |
| 2,125,624 | 8/1938 | Davis et al. | 299/5 |
| 2,902,418 | 9/1959 | Burns | 423/208 X |
| 3,606,466 | 9/1971 | Fernandes | 299/5 |
| 3,891,397 | 6/1975 | Fiedelman | 299/5 X |
| 3,914,945 | 10/1975 | Bietlot | 299/4 X |
| 3,998,709 | 12/1976 | Winkler | 208/98 |
| 4,072,472 | 2/1978 | Lures | 299/5 X |

FOREIGN PATENT DOCUMENTS

| | | | |
|---|---|---|---|
| 764013 | 12/1956 | United Kingdom | 423/208 |
| 1113869 | 5/1968 | United Kingdom | 423/208 |

OTHER PUBLICATIONS

LaGess, "Disposal of Brine Treating Solids by Recycling to a Brine Well", Chlorine Bicentennial Symposium, 1974.

*Primary Examiner*—Stephen J. Novosad
*Assistant Examiner*—George A. Suchfield
*Attorney, Agent, or Firm*—James B. Haglind; Donald F. Clements

[57] ABSTRACT

Disposal of effluent solutions containing sodium sulfate in an ecologically safe and economically sound manner is accomplished in a process which admixes the effluent with the aqueous solution used as the mining solution in salt deposits. The effluent-containing mining solution is injected into the brine well to dissolve sodium chloride while inhibiting the dissolution of soluble calcium compounds. Brine recovered from the wells has a reduced concentration of dissolved calcium.

8 Claims, No Drawings

PROCESS FOR DISPOSAL OF SULFATE CONTAINING BRINES FROM DIAPHRAGM CELL CAUSTIC EVAPORATOR SYSTEMS

This invention relates to a process for the disposal of sulfate containing brines obtained in the electrolysis of alkali metal chlorides.

An important commercial method of producing chlorine and sodium hydroxide is by electrolysis of sodium chloride brines in diaphragm cells. The brines are produced by contacting a subterranean deposit of salt with an aqueous solution to dissolve sufficient salt to produce a concentrated brine. Salt deposits contain soluble impurities such as calcium and sulfate which are also dissolved by the aqueous solution. Calcium is removed in an insoluble sludge by treating the brine with alkaline agents such as sodium carbonate and sodium hydroxide. This sludge is a waste product which is subsequently disposed of.

Soluble sodium sulfate in the brine passes through the diaphragm during electrolysis and is found in the cell liquor produced in the cell. Cell liquor is an aqueous solution of sodium hydroxide and sodium chloride. Concentrated sodium hydroxide is recovered from the cell liquor by evaporation. The remaining salt solution is subsequently processed to recover crystalline sodium chloride. Following the removal of sodium chloride, an alkaline solution of sodium chloride containing sodium sulfate remains as an effluent.

One method of disposing of this effluent is to admix it with calcium chloride to convert the sodium sulfate to calcium sulfate which is removed as a precipitate. In addition to the expense required by the chemical treatment, the method produces a second product which often has to be disposed of as a waste material.

A second method is to employ the solution in producing Glauber's salt, $Na_2SO_4.10H_2O$. As it requires heating and cooling cycles, this method requires additional expenditures for energy.

A third method is to discharge the solution to a repository such as an abandoned brine well or a body of water, for example, the ocean. This approach results in the loss of sodium chloride values and, for inland plants, may not be possible or ecologically acceptable.

Therefore, it is an object of the present invention to provide a process which recovers sodium chloride values from alkaline effluents containing sodium sulfate.

It is another object of the present invention to provide a process for the disposal of alkaline effluents containing sodium sulfate in an inexpensive and ecologically satisfactory manner.

These and other objects of the present invention are accomplished in a process for the disposal of an alkaline effluent solution containing sodium chloride, sodium sulfate and sodium hydroxide which comprises:

a. admixing the alkaline effluent solution with an aqueous solution to form a mining solution,
b. injecting the mining solution into a brine well to contact solid sodium chloride contaminated with a soluble calcium compound,
c. maintaining the mining solution in contact with the solid sodium chloride for a period sufficient to dissolve sodium chloride while inhibiting the solubility of the calcium compound to form a sodium chloride brine containing sodium sulfate, and d. extracting the sodium chloride brine from the brine well having reduced concentrations of dissolved calcium.

More in detail, the alkaline effluent solution treated by the process of the present invention is generated during the concentration of cell liquors from diaphragm cells used to electrolyze sodium chloride brines in the production of chlorine and sodium hydroxide. Cell liquors are aqueous solutions of sodium hydroxide and sodium chloride having concentrations in the range from about 1 to about 15 percent by weight of NaOH and from about 25 to about 12 percent by weight of NaCl. Cell liquors also contain sodium sulfate as a primary impurity. Sodium sulfate is present in amounts of from about 0.1 to about 2.0 percent by weight of $Na_2SO_4$.

Cell liquor is concentrated, for example, in a multiple effect evaporation system. During the evaporation process, the sodium hydroxide solution is concentrated while sodium chloride crystallizes. Along with sodium chloride crystals, the sodium sulfate present comes out as a triple salt, a gelatinous material containing NaCl, $Na_2SO_4$, and NaOH. Separation equipment is employed to remove concentrated caustic solutions containing about 50 percent by weight of NaOH and small amounts, e.g. about one percent by weight of NaCl from crystalline sodium chloride and the triple salt.

This mixture of sodium chloride and triple salt is fed to an agitated slurry tank to which a cold liquid such as brine or water is added in amounts sufficient to redissolve the triple salt from the crystalline sodium chloride. Sodium chloride crystals are separated and an alkaline effluent solution obtained.

The alkaline effluent solution comprises an aqueous solution of sodium chloride having dissolved therein sodium sulfate and made alkaline by small amounts of sodium hydroxide. Sodium chloride concentrations are from about 15 to about 27 percent by weight while the concentration of sodium sulfate is in the range from about 0.1 to about 7 percent by weight. Sodium hydroxide is present in the effluent solution in amounts of from about 0.1 to about 2.0 percent by weight.

To recover sodium chloride values from this alkaline effluent solution, it is admixed with an aqueous solution used to dissolve sodium chloride from a subterranean salt deposit, i.e., a brine well. This aqueous solution can be, for example, a fresh water supply, a waste water stream from a settling or waste treatment pond or a mixture of fresh water with waste water.

All or a portion of the alkaline effluent solution may be admixed with the aqueous solution. Alkaline effluent solution is admixed with the aqueous solution in amounts sufficient to form a mining solution having a sodium sulfate concentration which is equal to or greater than the concentration of soluble calcium compounds found in the salt deposit. The concentration of sodium sulfate may be, for example, from about 0.1 to about 60, preferably from about 2 to about 20 and more preferably from about 3 to about 10 grams per liter. The mixing may take place prior to or during injection of the mining solution into the brine well. Injection of the mining solution takes place, for example, by forcing the solution into the well through a pipe. The mining solution may be injected at any depth but is preferably injected at the bottom of the well.

Sodium hydroxide present in the effluent solution inhibits dissolution of, for example, iron or magnesium by the mining solution. Where iron or magnesium salts are dissolved in the mining solution, the sodium hydroxide will remove them by forming insoluble precipitates.

Within the brine well, the mining solution contacts the salt deposit to dissolve sodium chloride to produce a concentrated brine. Sodium sulfate present in the mining solution inhibits the dissolution of calcium found in contaminants in the salt deposit such as calcium chloride or calcium sulfate present as anhydrite or gypsum. Suitable mixing is obtained by retaining the injected mining solution in the brine well for a period of at least one month.

During the period in which the sodium sulfate containing mining solution is in contact with the salt deposit, if the soluble calcium contaminants in the salt are more soluble than calcium sulfate, e.g. calcium chloride, the calcium in the brine reacts with sodium sulfate present and calcium sulfate is precipitated from the brine solution. Where the soluble calcium contaminants have the same solubility or are less soluble than calcium sulfate, the presence of sodium sulfate inhibits the calcium contaminants from dissolving into the brine solution.

In the development of a brine well, the mining solution dissolves salt from the deposit to form a brine cavity. A portion of the brine produced remains in the brine cavity in contact with the salt deposit. During the initial stages of development of a brine well, where calcium sulfate is a contaminant in the salt deposit and the brine cavity is relatively small, it may be advantageous to control the amounts of alkaline effluent solution containing sodium sulfate added to the mining solution to limit the concentration of sulfate in the brine produced. Brines electrolyzed in diaphragm cells cannot tolerate excessive amounts of sulfate ion. However, as the well develops and the brine well cavity enlarges, the novel process of the present invention permits increasing amounts of the effluent to be admixed with the mining solution without increasing the sulfate concentration of freshly produced brine beyond acceptable limits.

The process thus permits the recovery of all of the sodium chloride from the alkaline effluent brine while maintaining the concentration of sulfate dissolving into the brine equal to the sulfate concentration of brine remaining in the brine cavity. No additional effluent disposal methods for the alkaline effluent are required and the sulfate concentration of brine fed to the diaphragm cells is controlled within desired limits.

At the end of the residence period, concentrated brine removed from the well for treatment prior to its electrolysis has a dissolved calcium concentration which is equal to or less than the concentration of soluble calcium salts found in the salt deposit. In the preferred embodiment, the dissolved calcium concentration is less than that of the salt deposit. The reduction in dissolved calcium found in brines from the effluent treated wells may be from about 10 to about 90, and preferably is from about 30 to about 80 percent of the calcium concentration of soluble calcium contaminants found in the salt deposit.

A reduction in calcium concentration in the brine produced permits a reduction in the amount of sodium carbonate which is required to treat the brine for removal of dissolved calcium by forming insoluble calcium carbonate. An additional benefit in the reduction of dissolved calcium in the brine is the reduction in volume of sludges containing insoluble calcium salts which must be disposed of.

In another embodiment, the mining solution containing sodium sulfate may be treated with a sequestering agent such as sodium hexametaphosphate, sodium pyrophosphate, sodium tripolyphosphate or mixtures thereof. The sequestering agent aids in inhibiting the dissolution of calcium contaminants in the salt deposit. When added to the mining solution, suitable amounts of the sequestering agent include those in the range of from about 2 to about 20, and preferably from about 5 to about 10 parts per million.

It may also be desirable to provide the mining solution containing sodium sulfate with carbonate ions. Carbonate ions may be provided by supplying gaseous carbon dioxide or a water soluble carbonate to the mining solution itself or to either of its components, the alkaline effluent solution or the aqueous solution. The presence of carbonate ions in the mining solution is believed to further inhibit the dissolution of calcium ions from the salt deposit.

During the operation of a diaphragm cell chloralkali plant, aqueous streams, slurries, and solutions are generated which are necessarily recovered to reduce fresh water requirements and to prevent pollution of natural resources. These effluents which include, for example, liquids used in the cooling and scrubbing of hydrogen gas and sludges from the brine treatment operation, are pumped to a sludge pond where solids present are deposited. The supernatant liquid is transferred to a waste solution pond. Prior to its reuse, the waste solution is monitored for its alkaline content and the presence of available chlorine. Should the solution be excessively alkaline, an acid such as sulfuric or hydrochloric is added. Available chlorine present in the solution can be removed by the addition of a reagent such as sodium sulfite. Following either or both of the above treatments, if required, the waste solution is a dilute alkaline brine solution having varying amounts of chlorides, hydroxides, carbonates, and sulfates and a pH below about 10.5. This waste solution may be used as all or part of the mining solution for the production of brine.

The novel process of the present invention provides for the recovery of sodium chloride values from an alkaline effluent solution. Further, the process reduces the concentration of calcium ions in the brine produced in the brine wells while disposing of an effluent solution in an inexpensive and ecologically satisfactory way.

The process of the present invention is further illustrated by the following example. All percentages used are by weight unless otherwise specified.

EXAMPLE

Fresh water was injected into a salt deposit contaminated with calcium sulfate (as anhydrite) to produce a saturated sodium chlorine brine having a dissolved calcium ion concentration of 1.6 grams per liter. The brine was treated with sodium carbonate and sodium hydroxide to remove dissolved calcium and produce a finished brine free of dissolved calcium. Finished brine was electrolyzed in diaphragm cells and a cell liquor produced in the cells having a sodium hydroxide concentration of 12.2 percent by weight and a sodium chloride concentration of 14.6 percent by weight and containing the dissolved sulfate. The cell liquor was concentrated in a multiple effect evaporation system to produce an aqueous solution containing 50 percent by weight of sodium hydroxide and about one percent by weight of sodium chloride. Also recovered was a mixture of sodium chloride crystals and gelatinous triple salt, $NaCl$-$Na_2SO_4$-$NaOH$ in a sodium chloride solution. The mixture was fed to a tank into which cold water was introduced to redissolve the triple salt to produce a slurry of crystalline sodium chloride in an alkaline effluent solution. This slurry was pumped to a centrifuge where the sodium chloride was removed and an effluent solution containing 24 percent by weight of sodium chloride, 4.4 percent by weight of sodium sulfate and 0.2 percent by weight of sodium hydroxide recovered. Sufficient amounts of the effluent solution recovered were mixed with a waste sodium chloride solution containing about 10 parts per million of dissolved carbonate to provide the waste solution with a sodium sulfate concentration of 8 grams per liter. This waste solution was being used as the mining solution in the production of additional brine. Also admixed with the mining solution was sufficient sodium hexametaphosphate to provide the solution with a concentration of about 6 parts per million. This mining solution containing the alkaline effluent was then injected into the bottom of the brine well. Within 10 months, the dissolved calcium concentration in brine removed from the well was 0.6 grams per liter. This reduction in soluble calcium concentration in the brine produced of about 62.5 percent indicates the successful inhibition of calcium dissolution from the salt deposit obtained by the process of the present invention.

What is claimed is:

1. A process for the disposal of an alkaline effluent solution containing sodium chloride, sodium sulfate and sodium hydroxide which comprises:

a. admixing said alkaline effluent solution for disposal with an aqueous solution to form a mining solution, b. injecting said mining solution into a brine well to contact solid sodium chloride contaminated with a soluble calcium compound, c. maintaining said mining solution in contact with said solid sodium chloride for a period sufficient to dissolve sodium chloride while inhibiting the solubility of said calcium compound to form a sodium chloride brine containing sodium sulfate, and d. extracting said sodium chloride brine from said brine well having reduced concentrations of dissolved calcium.

2. The process of claim 1 in which said aqueous solution is selected from the group consisting of fresh water, waste water and mixtures thereof.

3. The process of claim 2 in which said alkaline effluent solution contains from about 0.1 to about 7 percent by weight of sodium sulfate, from about 15 to about 27 percent by weight of sodium chloride and from about 0.1 to about 2 percent by weight of sodium hydroxide.

4. The process of claim 3 in which the sodium sulfate concentration in said mining solution is equal to or greater than the concentration of said soluble calcium compound in said solid salt deposit.

5. The process of claim 4 in which in step (a) a sequestering agent is added to said mining solution.

6. The process of claim 5 in which said aqueous solution is a waste water comprised of sodium chloride brine containing dissolved carbonate values.

7. The process of claim 5 or 6 in which said sequestering agent is sodium hexametaphosphate.

8. The process of claim 2 in which said soluble calcium compound is calcium sulfate.

* * * * *